US006138882A

United States Patent [19]

Buettner

[11] Patent Number: 6,138,882

[45] Date of Patent: Oct. 31, 2000

[54] UNIVERSAL CARRIER FOR BOTTLES, BEVERAGE CONTAINERS AND OTHER PROJECTS

[76] Inventor: Dale T. Buettner, 10286 Baco Cir., Naples, Fla. 34109

[21] Appl. No.: 09/378,863

[22] Filed: Aug. 23, 1999

[51] Int. Cl.[7] ..... A45F 3/14

[52] U.S. Cl. ..... 224/250; 224/651; 224/901; 224/901.4; 190/102; 248/104; 24/306

[58] Field of Search ..... 224/250, 651, 224/901, 901.2, 901.4, 901.6, 572, 463; 248/104; 190/102; 24/306, 16 R, 442

[56] References Cited

U.S. PATENT DOCUMENTS

| | | | |
|---|---|---|---|
| 603,018 | 4/1898 | Beck | 224/463 X |
| 1,385,085 | 7/1921 | Mahoney . | |
| 1,635,789 | 7/1927 | Hyman . | |
| 2,539,698 | 1/1951 | Pearson | 248/104 |
| 3,543,976 | 12/1970 | Ronald . | |
| 3,640,273 | 2/1972 | Ray | 24/306 X |
| 3,947,927 | 4/1976 | Rosenthal | 24/16 R |
| 3,994,048 | 11/1976 | Rosenthal | 24/16 R |
| 4,630,793 | 12/1986 | Hunter | 248/102 |
| 4,893,381 | 1/1990 | Frankel | 24/442 X |
| 4,911,271 | 3/1990 | Stanley | 190/102 |
| 4,946,119 | 8/1990 | Hellhake | 248/102 |
| 5,582,337 | 12/1996 | McPherson et al. | 24/306 X |
| 5,613,657 | 3/1997 | Olaiz | 248/102 |
| 5,622,346 | 4/1997 | Story, Jr. | 248/311.2 |
| 5,806,730 | 9/1998 | Deno | 224/148.6 |
| 5,862,927 | 1/1999 | Tebeau | 215/11.1 |

FOREIGN PATENT DOCUMENTS

| | | | |
|---|---|---|---|
| 202688 | 5/1939 | Switzerland | 190/102 |
| 382924 | 11/1932 | United Kingdom | 190/102 |

*Primary Examiner*—Gregory M. Vidovich
*Attorney, Agent, or Firm*—Edward M. Livingston, Esq.

[57] ABSTRACT

A light weight and easy to use strap-like device (1) for carrying bottles (1) and other containers by securing them to a handle (2) of another object. The device has a buckle (8) at a proximal end. A first side of the strap near the proximal end has matching fastening means which is spaced apart a sufficient distance so when connected around a handle (2) it forms an attachment loop (5) for attaching the device to the handle (2) of another object. The second or opposite side of the strap contains fastening means, such as hook and loop fastening material (10,11), with the distal portion of the strap containing one component of the fastening means, such as hook fabric (11), and the remaining portion having loop fabric (10). After the device has been attached to a handle of another object, a bottle (4) or other object is wrapped in the first side of the loop (6) and the distal end of the strap is placed around the bottle and pulled through the buckle (8) until the bottle is securely held in place. The fastening means at the distal end is secured to the fastening material on the second side of the strap to securely hold a bottle carrier. This device frees up a person's hands from having to carry a bottle, beverage container or other object and makes it available for use as needed.

8 Claims, 2 Drawing Sheets

UNIVERSAL CARRIER FOR BOTTLES, BEVERAGE CONTAINERS AND OTHER PROJECTS

BACKGROUND OF THE INVENTION

This invention relates to devices for carrying objects and more particularly, to a strap-like device for holding and carrying various sizes of bottles, beverage containers and other items by attachment to another object, such as luggage, briefcase, computer case, pocketbook, belt or railing.

In recent years it has become commonplace for people to carry bottles of water or other beverages with them, particularly while traveling. The latter is perhaps most likely due to health concerns about drinking water in general. Whatever the reasons may be, people who carry bottles usually must carry them in one hand which prevents that hand from being used for anything else. Unfortunately, removing one hand for use presents a particular problem with travelers who may also be carrying a luggage, briefcase, computer case, pocketbook and other items.

Thus, there exists a need for a device for holding and carrying any bottle, beverage container or other item by attachment to the handle of another object, such as luggage, a pocketbook or briefcase, to free-up one's hand and make the bottle easily accessible for drinking.

The prior art contains numerous bottle holders, particularly for baby bottles, but none like the present invention. For instance, U.S. Pat. No. 1,385,085 issued to Mahoney on Jul. 19, 1921, shows a baby bottle holder using a strap buckled around the bottle and a snap hook with ring to attach it to a carrier. U.S. Pat. No. 2,539,698 issued to Pearson on Jan. 30, 1951, shows another nursing bottle holder which uses straps with snaps to secure the bottle. U.S. Pat. No. 4,946,119 issued to Hellhake on Aug. 7, 1990, discloses another nursing bottle holder using straps with a buckle which is adjustable. U.S. Pat. No. 5,862,927 issued to Tebeau on Jan. 26, 1999, discloses a baby bottle holder using straps to form two loops, one loop for around the bottle and the other around an object with the straps being secured by VELCRO® fastening material. U.S. Pat. No. 5,622,346 issued to Story, Jr. on Apr. 22, 1997, discloses a bottle carrier having a plurality of straps to wrap around the bottle and secure it to a belt. U.S. Pat. No. 5,806,730 issued to Deno on Sep. 15, 1998, discloses another holder for a bottle. U.S. Pat. No. 5,613,657 issued to Olaiz on Mar. 25, 1997, discloses a baby bottle keeper having a ring to fit around a bottle neck and a strap with VELCRO® fastening material to secure the bottle to a crib. U.S. Pat. No. 4,630,793 issued to Hunter on Dec. 23, 1986, shows a belt for holding a baby bottle in the center attaching it to both sides of a stroller. U.S. Pat. No. 3,543,976 issued Ronald on Dec. 1, 1970, discloses a bottle holder using straps, buckles and snaps to secure the bottle around the neck of a baby. Finally, U.S. Pat. No. 1,635,789 issued to Hyman on Jul. 12, 1927, discloses another baby bottle holder which uses snaps and a snap hook.

None of the above patents shows a bottle holder having a structure like the present invention that is designed to hold and carry any bottle, beverage container or other object.

SUMMARY OF THE INVENTION

The primary object of the present invention is to provide a carrier for a bottle or beverage container which allows it to be secured to another object, such as a handle of luggage, briefcase, computer case or pocketbook.

Another object of the present invention is to provide such a device that is adjustable to fit around bottles, beverage containers or other objects.

A further object of the present invention is to provide such a carrying device that is easy to use.

A further object of the present invention is to provide such a device that is lightweight.

An additional object of the present invention is to provide such a device that is easy to store.

The present invention fulfills the above and other objects by providing a device for carrying bottles, other beverage containers or objects and items being an elongated strap with two sides having a buckle at a proximal end and two matching fastening means on a first side of the strap. The two fastening means on the first side of the strap are spaced apart so when connected to each other they form a loop for securing the strap to the handle or strap of another object. The second side of the strap is covered entirely with fastening means. One component of the fastening means covers a portion near the distal end of the strap and a matching or complementary fastening means covers the remaining portion of the second side of the strap so that when the distal end of the strap is run through the buckle on the proximal end, it can be adjustably tightened around a bottle, beverage container or other object and attached by the fastening means to the fastening means on the remainder of the strap to form a secure loop around a beverage container. To use the device of the present invention, first the two matching fastening means on the first side are placed around the handle of a strap of another object, like luggage, a briefcase, a computer case or a pocketbook, and fastened together to form a holding loop. Then the distal end of the strap is wrapped around a bottle or beverage container to be carried, run through the buckle on the proximal end of the strap and pulled until it forms a snug loop around the bottle, beverage container or other object. Finally, the distal end of the strap is attached to the matching fastening means on the outer portion of the strap to secure the loop around the bottle, beverage container or other object.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
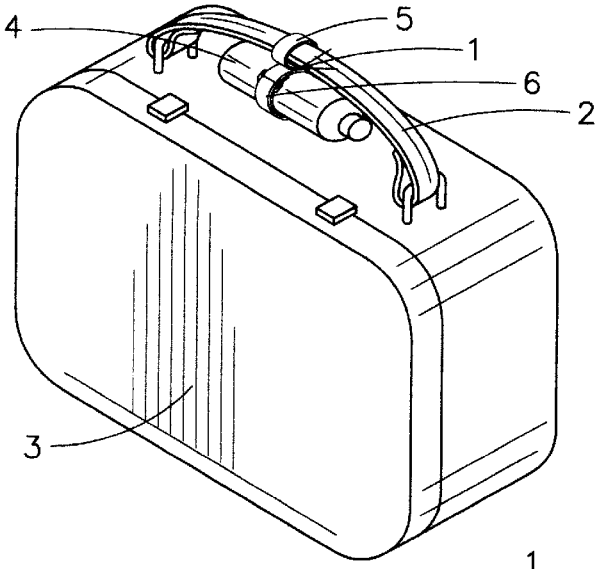
FIG. 1 is a perspective view of the universal bottle carrier of this invention in use showing a bottle attached to luggage.
Figure 2:
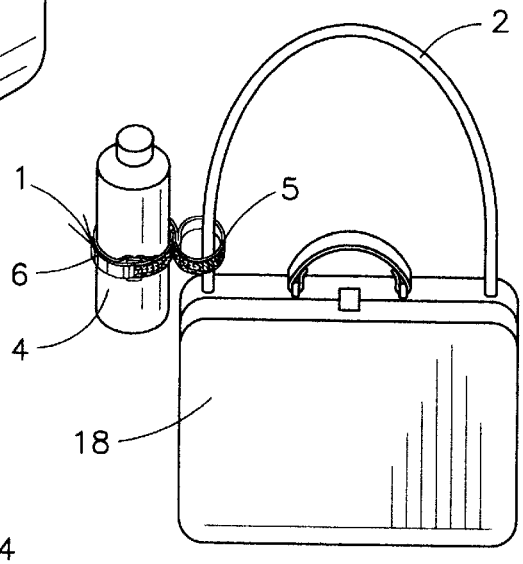
FIG. 2 is a perspective view of the universal bottle carrier of this invention in use showing a bottle attached to a computer case.
Figure 3:
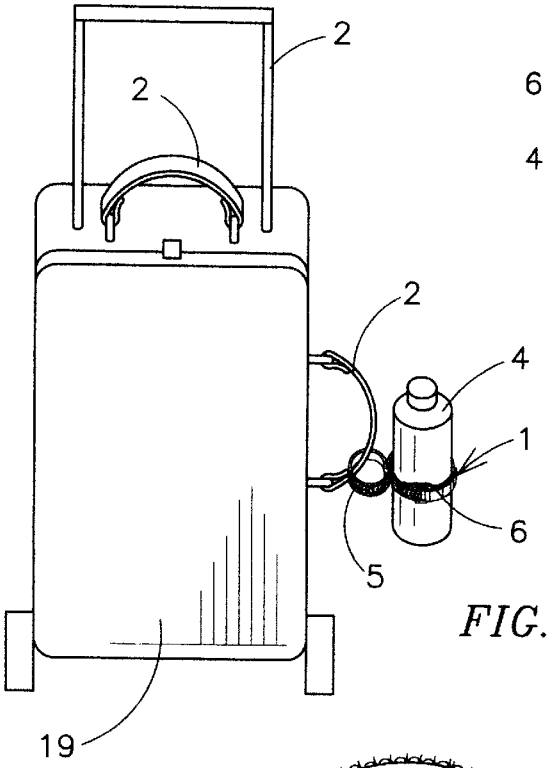
FIG. 3 is a perspective view of the universal bottle carrier of this invention in use showing a bottle attached to travel luggage.

For purposes of describing the preferred embodiment, the terminology used in reference to the numbered components in the drawings is as follows:

1. bottle carrier
2. handle/strap
3. luggage
4. bottle
5. attachment loop of bottle carrier
6. bottle holding loop of bottle carrier
7. snap
8. buckle
9. distal end of strap
10. loop component of fastening material
11. hook component of fastening material
12. inside surface of bottle holding loop
13. outside surface of bottle holding loop
14. inside surface of attachment loop
15. male strap component
16. female strap component
17. stop extension flap
18. computer case
19. travel luggage Referring now to the drawings, FIGS. 1, 2 and 3 shows the universal bottle carrier 1 attached to a handle 2 of luggage 3, computer case 18 or travel luggage 19 with a bottle 4 being snugly held in a bottle holding loop 6 and attached to any handle or strap 2 by an attachment loop 5 of the bottle carrier 1.

Figure 4:
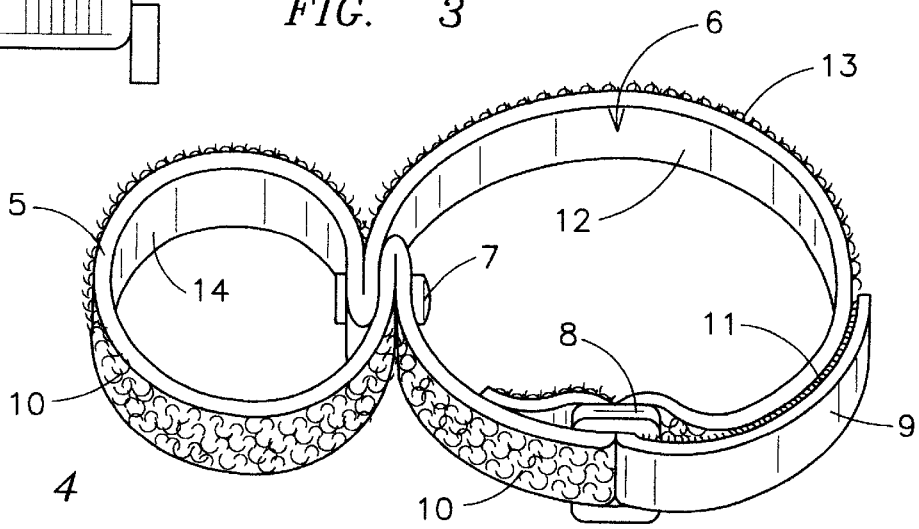
FIG. 4 is a side view of the universal bottle carrying device by itself in a use position.

In FIG. 4 the bottle carrier is shown in the use position without a bottle. The handle attachment loop of the bottle carrier 5 is shown being formed and held in place by a fastening means, such as a snap 7. The outside of the attachment loop 5 may be clear or even covered by fastening material 10 to provide for increased adjustability in size when holding very small bottles. The bottle holding loop 6 is shown being formed by a buckle 8 through which the distal end of the strap 9 is run and pulled around a bottle and secured by attaching matching fastening material, such as hook and loop fastening material 11 and matching loop material 10 on the outer surface of the outer surface 13 of the loop. The inside surface 12 of the bottle holding loop 6 is generally smooth.

Figure 5:
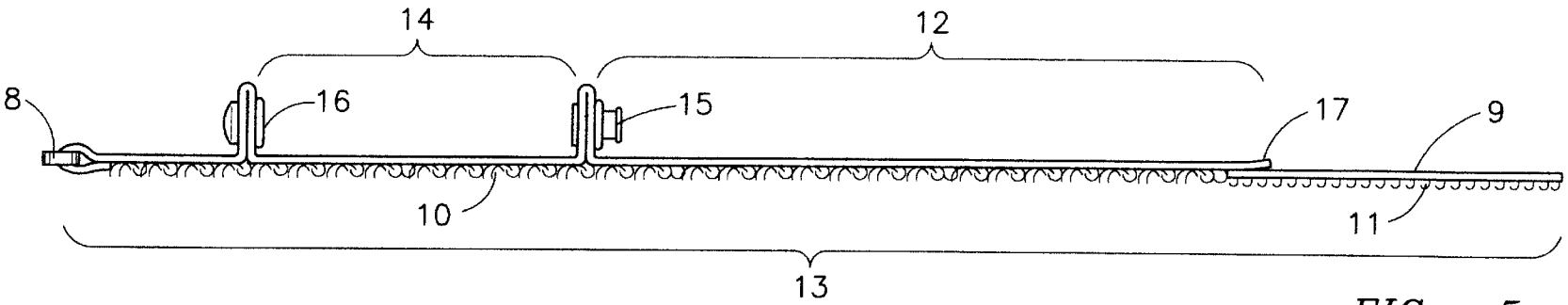
FIG. 5 is a side view of the bottle carrier in an open position prior to use.
Figure 6:
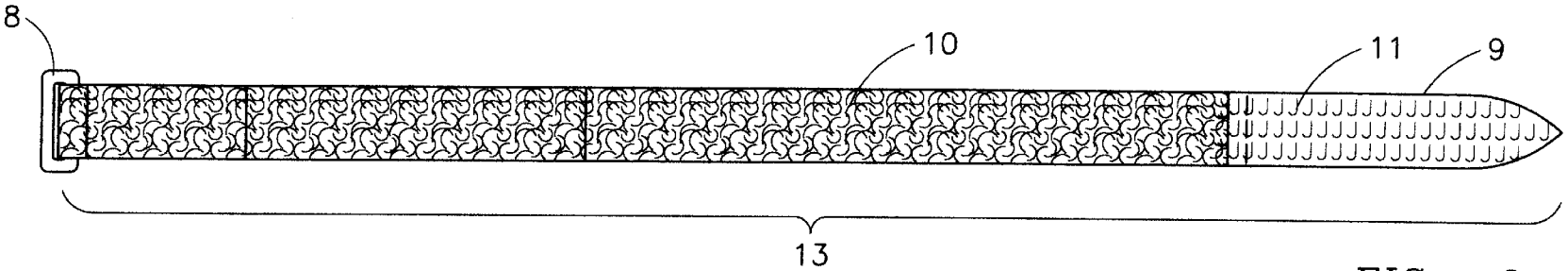
FIG. 6 is an elevational view of the outside surface of the bottle carrier in an open position prior to use.
Figure 7:
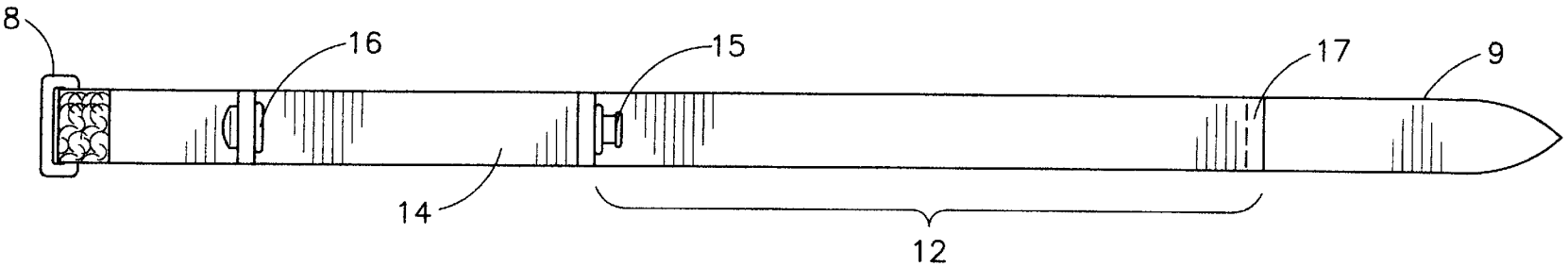
FIG. 7 is an elevational view of the inside surface of the bottle holding side of the bottle carrier in an open position prior to use.

FIGS. 5, 6 and 7 show the bottle holding carrier of the present invention in a non-use condition. As shown at a proximal end of the strap-like carrier is a buckle 8 secured to the fabric of the strap. A short distance from the buckle 8 are two matching fastening means 16 and 15 which are spaced apart a sufficient distance so that when connected they form an attachment loop having an inside surface 14 which secures the strap to the handle of an object. As shown, the matching fastening means 15 and 16 may consist of a male and female snap component, respectively. The remaining inside surface consists of the bottle wrapping portion 12 and the distal end 9.

The outside surface of the bottle holding loop 13 is covered by fastening means 10 and 11 so that when the distal end 9 is placed through the buckle 8 the bottle holding loop 6 is formed in a manner such that the size of the loop is adjustable to fit any size bottle. The fastening means 10 and 11 would preferably be matching fastening means with one component, such as a hook component 11 covering a portion of the distal end. The remaining portion 10 being covered by matching fastening material, such as loop component shown. An extension or flap 17 is provided at the end of the inside surface 12 of the bottle wrapping loop to keep the distal end 9 of the strap from easily coming back through the buckle 8 when the bottle holding loop 6 is formed.

The procedure for using the present device to secure a bottle are to first secure the strap to a handle of another object, such as luggage, a briefcase, a computer case, a pocketbook or even railing, by placing the inside surface of the attachment loop 14 next to the handle and securing the strap around the handle by attaching the two matching fastening means, in this case inserting the male component 15 to the female component 16 of the snap. Once the strap is attached to the handle 2, then the inside surface 12 is placed around the beverage container and the distal end 9 is run through the buckle 8, placed around the bottled and pulled until the bottle is snugly fit. Finally, the fastening means 11 is secured to the fastening means 10 to secure the bottle holding loop 6 in place. In this position a bottle or beverage container 4 can be carried and the bottle can be easily removed by pulling the bottle out of the holding loop 6 by unfastening the distal end 9 of the strap to release the bottle and re-fastening it to put the bottle back in place.

Alternatively, a person could even drink from a bottle without removing it from the strap by merely tilting the bottle toward herself or himself and drinking.

Although only a preferred embodiment of the present invention has been described in detail hereinabove primarily in conjunction with carrying bottles or beverage containers, other improvements, modifications to and uses of this invention, such as to secure objects to a railing of a boat, are deemed to be included in the scope of this invention.

Having thus described my invention, I claim:

1. A device for carrying bottles, beverage containers and other objects comprising:

an elongated strap having a buckle at a proximal end and first and second sides;

first and second matching fastening means near the proximal end on the first side of the strap which are spaced apart and connectable to form a closed attachment loop with the inner periphery of the loop defined by the portion of the strap between the first and second fastening means for securing the strap to another object; and a third fastening means on a portion of a distal end of the second side of the strap and a fourth matching fastening means on a remaining portion of the second side of the strap so when the distal end of the strap with the second side facing outward is placed through the buckle and the third and fourth fastening means secured to each other, an adjustable-size loop is formed to fit around bottles, other beverage containers and objects to be carried.

2. The device of claim 1 wherein the first and second matching fastening means on the first side of the strap are male and female snap components.

3. The device of claim 1 wherein the third and fourth matching fastening means are hook and loop fastening material.

4. The device of claim 2 wherein the third and fourth matching fastening means are hook and loop fastening material.

5. A method for carrying bottles, beverage containers and other objects using an elongated strap having a buckle at a proximal end and first and second sides; first and second matching fastening means near the proximal end on the first side of the strap which are spaced apart and connectable to form a closed attachment loop with the inner periphery of the loop defined by the portion of the strap between the first and second fastening means for securing the strap to another object; and a third fastening means on a portion of a distal end of the second side of the strap and a fourth matching fastening means on a remaining portion of the second side of the strap so when the distal end of the strap with the second side facing outward is placed through the buckle and the third and fourth fastening means secured to each other, an adjustable-size loop is formed to fit around bottles, other beverage containers and objects to be carried, said method comprising the steps of:

attaching the first and second fastening means together around an object to form the attachment loop around the object;

placing the second side of the strap around another object and running the distal end of the strap through the buckle on the proximal end of the strap;

pulling the distal end of the strap until it snugly fits around the another object; and attaching the third fastening means to the fourth attachment means to secure the adjustable size loop around the another object.

6. The method of claim 5 wherein the first and second matching fastening means are male and female snap components.

7. The method of claim 5 wherein the third and fourth matching fastening means is hook and loop fastening material.

8. The method of claim 6 wherein the third and fourth matching fastening means is hook and loop fastening material.

* * * * *

UNITED STATES PATENT AND TRADEMARK OFFICE

CERTIFICATE OF CORRECTION

PATENT NO. : 6,138,882
DATED : Oct. 31, 2000
INVENTOR(S) : Dale T. Buettner

It is certified that error appears in the above-identified patent and that said Letters Patent is hereby corrected as shown below:

On the cover page, in the title of invention, please delete "projects" and insert --objects-- in its place.

On the cover page, in the street address of the inventor, please delete "Baco" and insert --Boca-- in its place.

In column 1, line 3, please delete "projects" and insert --objects-- in its place.

Signed and Sealed this

First Day of May, 2001

*Attest:*

Nicholas P. Godici

NICHOLAS P. GODICI

*Attesting Officer*

*Acting Director of the United States Patent and Trademark Office*